US008528114B2

(12) United States Patent
Baiany

(10) Patent No.: US 8,528,114 B2
(45) Date of Patent: Sep. 10, 2013

(54) MEN'S SWIMSUIT

(75) Inventor: Zachary Baiany, Belmont, MA (US)

(73) Assignee: Zachary Baiany, Belmont, MA (US)

( * ) Notice: Subject to any disclaimer, the term of this patent is extended or adjusted under 35 U.S.C. 154(b) by 983 days.

(21) Appl. No.: 11/851,089

(22) Filed: Sep. 6, 2007

(65) Prior Publication Data

US 2009/0064388 A1 Mar. 12, 2009

(51) Int. Cl.
*A41D 7/00* (2006.01)

(52) U.S. Cl.
USPC ..... 2/67; 2/228; 2/238

(58) Field of Classification Search
USPC ..... 2/67, 228, 238
See application file for complete search history.

(56) References Cited

U.S. PATENT DOCUMENTS

| | | | | |
|---|---|---|---|---|
| 20,567 | A * | 6/1858 | Bachelis | 48/120 |
| 2,446,326 | A * | 8/1948 | Guithues | 2/238 |
| 2,983,924 | A * | 5/1961 | Cohen et al. | 2/67 |
| 3,333,589 | A * | 8/1967 | Cohen et al. | 450/95 |
| 5,010,596 | A * | 4/1991 | Brown et al. | 2/228 |
| 6,088,832 | A * | 7/2000 | Newman | 2/67 |
| 7,251,840 | B2 * | 8/2007 | Bayer | 2/227 |
| 7,437,775 | B2 | 10/2008 | Reynolds | |
| 2005/0081275 | A1 * | 4/2005 | Galvao | 2/67 |

* cited by examiner

*Primary Examiner* — Alissa Tompkins
(74) *Attorney, Agent, or Firm* — Occhiuti Rohlicek & Tsao LLP

(57) ABSTRACT

A men's swimsuit that includes an outer shell having an outer-shell waistband; and an inner liner that defines an interior lumen. The inner liner includes an inner-liner waistband attached to the outer-shell waistband; and a pair of inner-liner leg sleeves extending from the inner-liner waistband. Each inner-liner leg sleeve terminates in a hem configured to exert a radially compressive force urging the hem against a thigh passing therethrough. As a result, the hems of the inner-liner leg sleeves, in cooperation with the inner-liner waistband, prevent particulate matter from reaching the interior lumen of the inner liner.

25 Claims, 3 Drawing Sheets

MEN'S SWIMSUIT

TECHNICAL FIELD

This invention relates to clothing, and in particular, to men's swimsuits.

BACKGROUND

People may wear swimsuits for various reasons, such as to go swimming at the beach or pool. Swimsuits generally cover parts of the swimsuit wearer's body. Swimsuits can also improve the user's overall experience at the beach or pool, such as during or after swimming.

SUMMARY

In one aspect, the invention features a men's swimsuit that includes an outer shell having an outer-shell waistband; and an inner liner that defines an interior lumen. The inner liner includes an inner-liner waistband attached to the outer-shell waistband; and a pair of inner-liner leg sleeves extending from the inner-liner waistband. Each inner-liner leg sleeve terminates in a hem configured to exert a radially compressive force urging the hem against a thigh passing therethrough. As a result, the hems of the inner-liner leg sleeves, in cooperation with the inner-liner waistband, prevent particulate matter from reaching the interior lumen of the inner liner.

In some embodiments, the hem is a form-fitting hem. Examples of such hems are those made of a form-fitting material. One such material is spandex. Other materials are those that include elastomeric fibers. Other examples of form-fitting hems include those having elastic bands, and those having a drawstring that, when tightened, exerts a radially compressive force.

In other embodiments, the portion of the inner liner between the hems and the waistband, the inner liner comprises a non-form-fitting material.

Other embodiments of the invention feature inner liners of various types. Among these embodiments are those in which the inner liner is made of a form-fitting material. Exemplary form fitting materials include those having elastomeric fibers. One such material is spandex.

In other embodiments, the inner liner includes a rapidly drying material.

Additional embodiments include those in which the inner liner includes a scrotal pouch.

In another aspect, the invention features a men's swimsuit having an outer shell; and an inner liner coupled to the outer shell. The inner liner defines a lumen for enclosing a pelvic region, and includes means for preventing particulate matter from entering the pelvic region.

In another aspect, the invention features a men's swimsuit having an outer shell having an outer-shell waistband; and an inner liner made of an elastomeric material, the inner liner defining an interior lumen. The inner liner includes an inner-liner waistband attached to the outer-shell waistband; and a pair of inner-liner leg sleeves extending from the inner-liner waistband. Each inner-liner leg sleeve terminates in a hem configured to exert a radially compressive force. As a result, the hems of the inner-liner leg sleeves, in cooperation with the inner-liner waistband, prevent particulate matter from reaching the interior lumen of the inner liner.

Embodiments of the swimsuit include those in which the inner-liner is a bikini inner-liner.

These, and other features and advantages of the invention will be apparent from the following detailed description and the accompanying figures, in which:

DESCRIPTION OF DRAWINGS

Like reference symbols in the various drawings indicate like elements.

DETAILED DESCRIPTION

Figure 1:
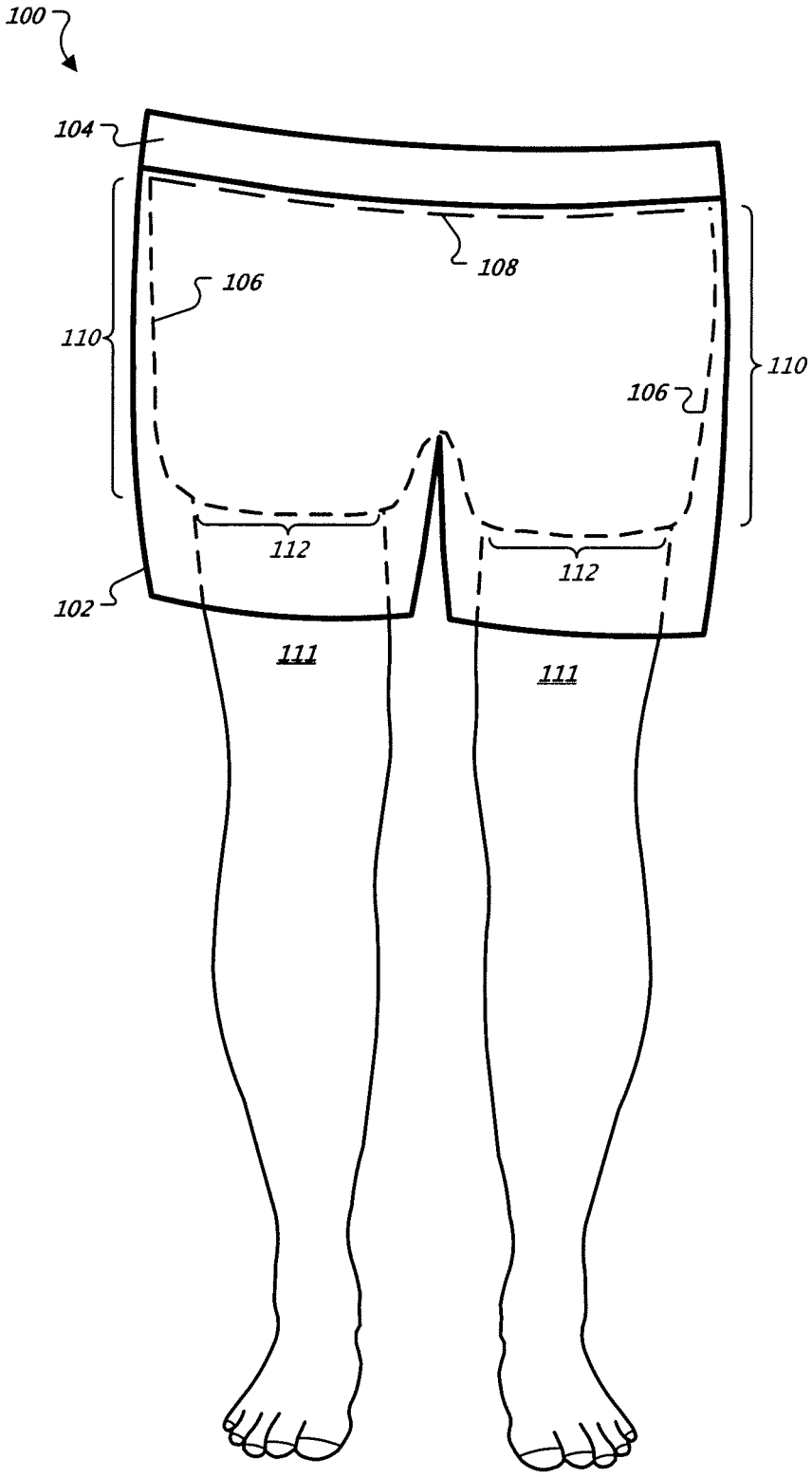
FIG. 1 shows an exemplary swimsuit.

FIG. 1 shows an exemplary swimsuit 100 worn about the upper legs and waist area of a man. However, other variations and/or sizes of the swimsuit 100 may be worn, for example, by a user or swimmer of any age.

The swimsuit 100 includes an outer shell 102 having an outer-shell waistband 104. The outer shell 102 may be constructed of any suitable fabric or other material, such as a material that can withstand getting wet (e.g., not disintegrate or significantly shrink, etc.). The outer-shell waistband 104 attached to the outer shell 102 can include elastic, a drawstring, or some combination thereof that can hold the swimsuit 100 in place along the user's waistline.

The swimsuit 100 also includes an inner liner 106 held in place by an inner-liner waistband 108. The inner-liner waistband 108 may be attached to the outer shell 102, such as by stitching into the outer-shell waistband 104. The inner liner 106 includes a pair of inner-liner leg sleeves 110 that fit over the user's thigh 111. A hem 112 at the end of each inner-liner leg sleeve 110 fits snugly over the user's thigh 111. All or some of the inner liner 106 can be constructed of a rapidly drying material, such as spandex, polyester, nylon, etc. The inner liner 106 forms an interior lumen, or inner region, of the swimsuit 100. As such, the interior lumen serves as a cavity for the upper leg and private portions of a male's body.

As used herein, a point on the surface of a leg is on the "thigh" if a line normal to the leg at that point intersects with the femur.

The materials used to construct parts of the swimsuit 100, and in particular the inner liner 106, may include elastomeric fibers or other such natural or synthetic materials that, at room temperature, can be expanded or stretched to about twice or more of their original length. For example, elastomeric fibers may include spandex, polyester, LYCRA®, or any manufactured fiber in which the fiber forming substance is a long-chain synthetic polymer comprised of, for instance, at least 85% of a segmented polyurethane.

In some implementations, the entire inner liner 106 can be constructed using, for example, a form-fitting material, such as spandex or some other synthetic fiber having exceptional elasticity. In other implementations, inner-liner waistband 108 and hems 112 may be constructed of spandex (or other stretchable material), and the remaining portions of the inner liner 106 may be constructed of a non-form-fitting material.

The hems 112 are generally configured to exert a radially compressive force. Specifically, the radially compressive force pulls the hem 112 generally toward the center of a circle representing the cross section of the swimsuit wearer's thigh 111. In particular, each point along the hem 112 can pull the hem 112 toward the middle of the swimsuit wearer's thigh 111. As such, the hems 112 can provide a tight fit between the hems 112 and the user's thighs 111. In some implementations, the hems 112 may be constructed of spandex or other stretchable material. In other implementations, the hems 112 may include drawstrings or elastic bands for providing the radially compressive force.

The inner liner 106 may prevent, for example, particulate matter (e.g., sand) from penetrating certain areas of the swimsuit 100. For example, the inner-liner waistband 108 prevents sand or other foreign material from entering through the top (or waist line area) of the swimsuit 100. Similarly, the hems 112 prevent sand or other material from entering the interior lumen of the inner liner 106. In this way, the form-fitting features of the swimsuit prevent sand or other particulate matter from reaching sensitive areas of the male anatomy. In some cases, the inner-liner waistband and the hems 112 may also prevent crawling insects from penetrating the interior of the inner liner 106. For example, the inner liner 106 may keep ticks or other such insects from reaching areas on the male's body, particularly hirsute areas, where they may go undetected.

Figure 2:
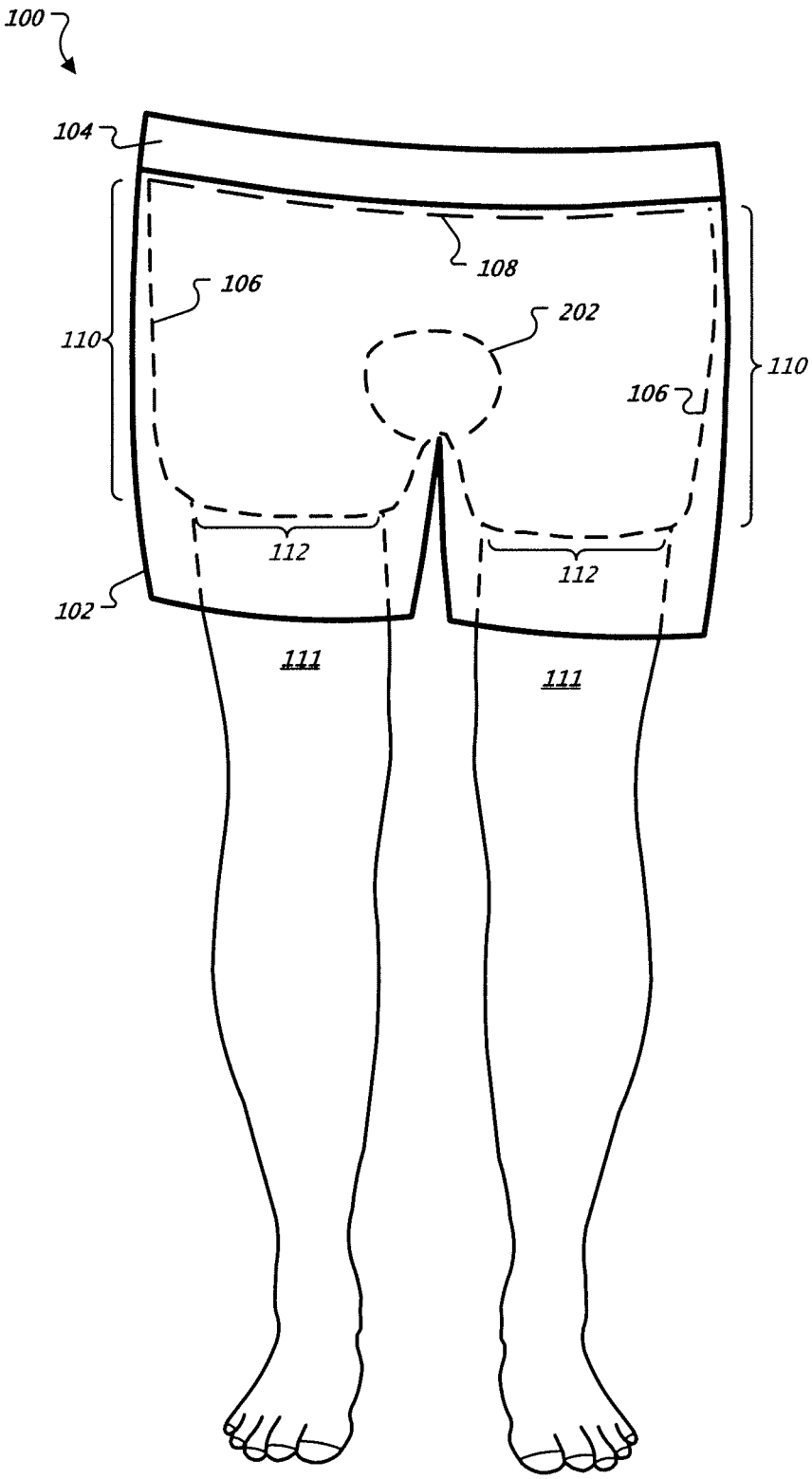
FIG. 2 shows an exemplary swimsuit that includes a scrotal pouch.

FIG. 2 shows an exemplary swimsuit 100 that includes a scrotal pouch 202. The scrotal pouch 202 may be used, for example, to support portions of a male's anatomy, or to restrict portions of the male's anatomy to remain within a cavity defined by the scrotal pouch 202. As such, the scrotal pouch 202 may serve as a type of jock strap embedded within the swimsuit 100. The scrotal pouch 202 may be constructed using the same form-fitting material as the inner liner 106, and as such, may be a separate compartment sewn into or along the inside of the inner liner 106. The material used to construct the scrotal pouch 202 can be the same material used to construct the inner liner 106. Using a rapidly drying material to construct the scrotal pouch 202 can provide the advantage of reducing the exposure of a male's anatomy to a wet swimsuit.

Figure 3:
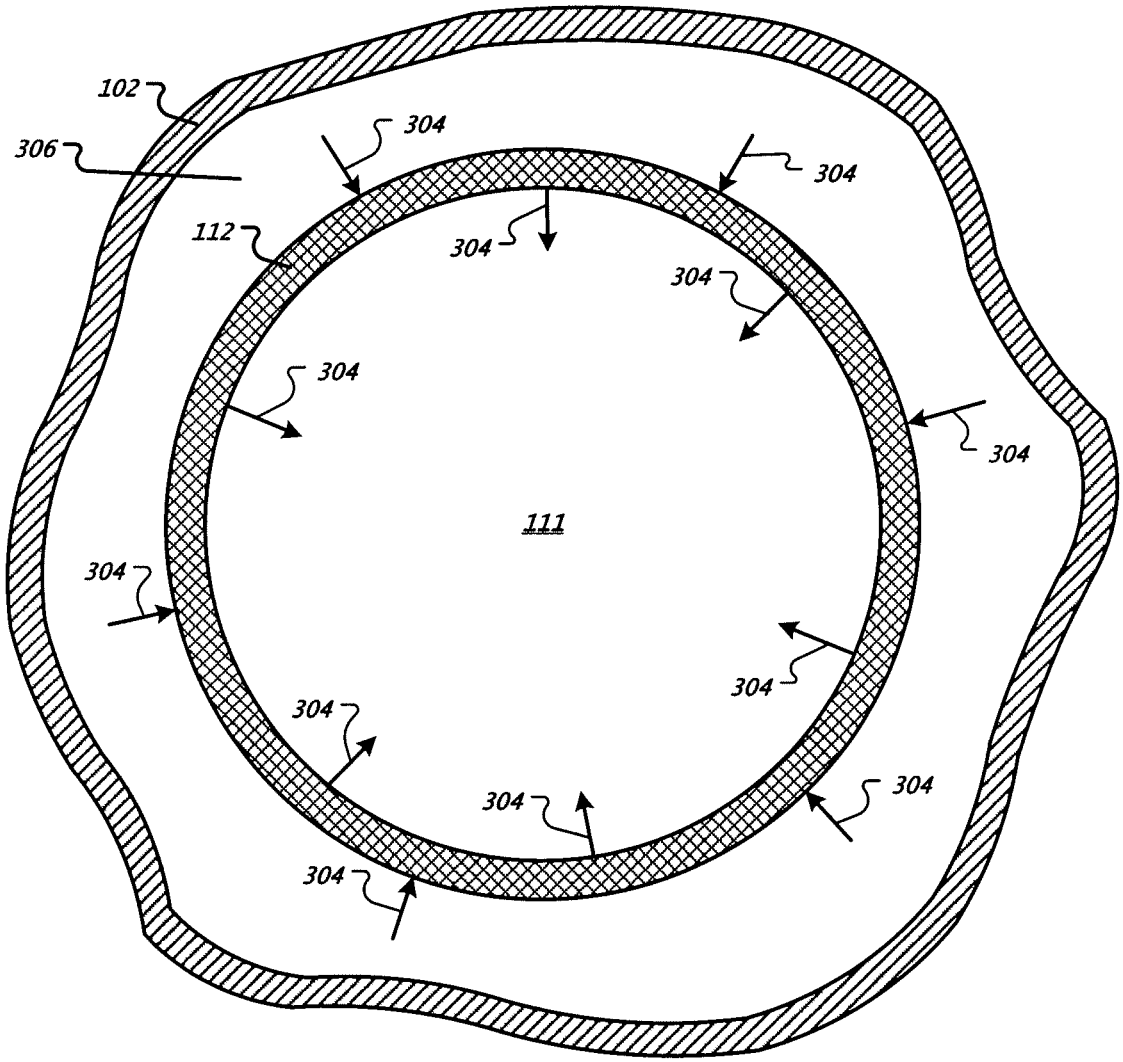
FIG. 3 shows examples of radially compressive forces that the hem of the swimsuit's inner liner can exert on a thigh.

FIG. 3 shows examples of radially compressive forces that the hem 112 of the swimsuit's inner liner 106 can exert on a thigh 111. As depicted, the hem 112 is held tightly against a thigh 111 (shown as a cross section) by compressive radial forces 304. Such forces 304 may be result from, for example, the nature of the material (e.g., spandex or other elastic material) used for the hem 112. A gap 306 exists between the hem 112 and the outer shell 102. As depicted, such a gap 306 represents the space between the swimsuit's outer shell 102 and the inner liner 106, specifically where the hem 112 fits snugly against the user's thigh 111.

In some embodiments, where elastic or drawstrings are used for the hems 112, compressive radial forces 304 may arise from such elastic or drawstrings. As a result of the compressive radial forces 304, the hem 112 can be held tightly against the user's thigh 111. Similarly, other such compressive radial forces 304 in the inner-liner waistband 108 can facilitate the tight fit of the inner-liner waistband 108 to the user's waistline.

In other embodiments, the inner-liner 106 is cut as a bikini, in which case the radially-compressive force is exerted just above the thigh along the contour defining the intersection of the femur and pelvis.

A number of embodiments of the invention have been described. Nevertheless, it will be understood that various modifications may be made without departing from the spirit and scope of the invention. Accordingly, other embodiments are within the scope of the following claims.

Having described the invention, and a preferred embodiment thereof, what I claim as new and secured by United States Letters Patent is:

1. A men's swimsuit comprising: an outer shell having an outer-shell waistband; and a form-fitting inner liner defining an interior lumen, the inner liner having: an inner-liner waistband attached to the outer-shell waistband; and a pair of inner-liner leg sleeves extending from the inner-liner waistband, each inner-liner leg sleeve terminating in a hem configured to exert a radially compressive force urging the hem against a thigh passing therethrough; whereby, the hems of the inner-liner leg sleeves, in cooperation with the inner-liner waistband, prevent particulate matter from reaching the interior lumen of the inner liner, wherein the inner liner comprises a form-fitting material, wherein the inner liner comprises a scrotal pouch.

2. The swimsuit of claim 1, wherein the inner liner comprises a long chain synthetic polymer having at least 85% segmented polyurethane.

3. The swimsuit of claim 1, wherein the inner liner comprises elastomeric fibers.

4. The swimsuit of claim 1, wherein the inner liner comprises spandex.

5. A men's swimsuit comprising an outer shell having an outer-shell waistband; and a form-fitting inner liner defining an interior lumen, the inner liner having: an inner-liner waistband attached to the outer-shell waistband; and a pair of inner-liner leg sleeves extending from the inner-liner waistband, each inner-liner leg sleeve terminating in a hem configured to exert a radially compressive force urging the hem against a thigh passing therethrough; whereby, the hems of the inner-liner leg sleeves, in cooperation with the inner-liner waistband, prevent particulate matter from reaching the interior lumen of the inner liner, wherein the inner liner comprises a form-fitting material, wherein the inner liner comprises a long chain synthetic polymer having at least 85% segmented polyurethane.

6. The swimsuit of claim 5, wherein the hems are form-fitting hems.

7. The swimsuit of claim 6, wherein the hems comprise a form-fitting material.

8. The swimsuit of claim 6, wherein the hems comprise elastic bands.

9. The swimsuit of claim 6, wherein the hems comprise a drawstring that, when tightened, exerts a radially compressive force.

10. The swimsuit of claim 7, wherein the hems comprise spandex.

11. The swimsuit of claim 7, wherein the hems comprise elastomeric fibers.

12. The swimsuit of claim 5, wherein the inner liner comprises a rapidly drying material.

13. The swimsuit of claim 5, wherein the inner-liner is a bikini inner-liner.

14. The swimsuit of claim 5, wherein the inner liner comprises a material that is stretchable to at least twice its length.

15. The swimsuit of claim 5, wherein the inner liner comprises a scrotal pouch.

16. The swimsuit of claim 5, wherein the inner liner comprises elastomeric fibers.

17. The swimsuit of claim 5, wherein the hems comprise a form-fitting material.

18. The swimsuit of claim 17, wherein the hems comprise spandex.

19. The swimsuit of claim 17, wherein the hems comprise elastomeric fibers.

20. The swimsuit of claim 5, wherein the hems comprise elastic bands.

21. The swimsuit of claim 5, wherein the hems comprise a drawstring that, when tightened, exerts a radially compressive force.

22. The swimsuit of claim 5, wherein the inner liner comprises a rapidly drying material.

23. The swimsuit of claim 5, wherein the inner-liner is a bikini inner-liner.

24. The swimsuit of claim 5, wherein the inner liner comprises a material that is stretchable to at least twice its length.

25. The swimsuit of claim 5, wherein the hems are form-fitting hems.

* * * * *